US010527028B2

(12) United States Patent
Tamashima et al.

(10) Patent No.: US 10,527,028 B2
(45) Date of Patent: Jan. 7, 2020

(54) PISTON AND LIQUID-PRESSURE ROTATING DEVICE INCLUDING SAME

(71) Applicant: KAWASAKI JUKOGYO KABUSHIKI KAISHA, Kobe-shi, Hyogo (JP)

(72) Inventors: Hideki Tamashima, Himeji (JP); Koji Matsuhisa, Kakogawa (JP); Kazuhiro Ishihara, Himeji (JP); Katsuyuki Kawashima, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 107 days.

(21) Appl. No.: 15/572,755

(22) PCT Filed: May 2, 2016

(86) PCT No.: PCT/JP2016/002244
§ 371 (c)(1),
(2) Date: Nov. 8, 2017

(87) PCT Pub. No.: WO2016/181638
PCT Pub. Date: Nov. 17, 2016

(65) Prior Publication Data

US 2018/0119683 A1 May 3, 2018

(30) Foreign Application Priority Data

May 8, 2015 (JP) ..... 2015-095798

(51) Int. Cl.
*F04B 1/12* (2006.01)

(52) U.S. Cl.
CPC ..... *F04B 1/124* (2013.01); *F04B 1/2092* (2013.01); *F04B 1/324* (2013.01)

(58) Field of Classification Search
CPC .... F04B 1/2092; F04B 1/324; F04B 39/0292; F04B 53/14; F16J 1/08; F16J 1/09; F16J 1/10; F01B 3/0085
See application file for complete search history.

(56) References Cited

U.S. PATENT DOCUMENTS 5,758,566 A 6/1998 Jepsen et al.
6,318,242 B1 * 11/2001 Stoppek ..... B23P 15/10 29/888.042

(Continued)

FOREIGN PATENT DOCUMENTS

EP 1134412 A2 9/2001
EP 1 750 009 A1 2/2007

(Continued)

OTHER PUBLICATIONS

Jul. 26, 2016 International Search Report issued in International Patent Application No. PCT/JP2016/002244.

*Primary Examiner* — F Daniel Lopez
*Assistant Examiner* — Matthew Wiblin
(74) *Attorney, Agent, or Firm* — Oliff PLC

(57) ABSTRACT

A piston is cylindrical and includes: a concave spherical portion formed at one of end portions of the piston and having a partially spherical shape; a cylindrical hollow portion formed at the other end portion of the piston; and an oil passage formed between the concave spherical portion and the hollow portion, the concave spherical portion and the hollow portion communicating with each other through the oil passage. The concave spherical portion includes a concave spherical surface formed by forging and having a partially spherical shape. A convex spherical portion of a shoe is supported by the concave spherical surface so as to be slidable and rotatable. An area of contact between the concave spherical surface and a predetermined master ball (Continued)

corresponding to the convex spherical portion is 40% or more of an entire area of the concave spherical surface.

11 Claims, 5 Drawing Sheets

(56) References Cited

U.S. PATENT DOCUMENTS

| | | | | |
|---|---|---|---|---|
| 6,338,293 | B1 * | 1/2002 | Johnson | F01B 3/0044 92/135 |
| 6,343,888 | B1 | 2/2002 | Huhn et al. | |
| 2004/0211314 | A1 | 10/2004 | Bousseau | |
| 2014/0283681 | A1 * | 9/2014 | Baeriswyl | F04B 1/124 92/172 |

FOREIGN PATENT DOCUMENTS

| | | | | |
|---|---|---|---|---|
| EP | 2159421 | A1 | 3/2010 | |
| FR | 2598463 | A1 * | 11/1987 | F01L 1/185 |
| GB | 1177633 | A * | 1/1970 | F01B 3/0085 |
| JP | S51-14284 | B1 | 5/1976 | |
| JP | 2000-220567 | A | 8/2000 | |
| JP | 2000-257549 | A | 9/2000 | |
| JP | 2005-061282 | A | 3/2005 | |
| JP | 2014-152753 | A | 8/2014 | |
| WO | 98/42949 | A1 | 10/1998 | |

* cited by examiner

PISTON AND LIQUID-PRESSURE ROTATING DEVICE INCLUDING SAME

TECHNICAL FIELD

The present invention relates to a piston configured to reciprocate and a liquid-pressure rotating device including the piston.

BACKGROUND ART

As pistons used in swash plate type hydraulic pumps, hydraulic motors, and the like, there are male pistons and female pistons. Known as a liquid-pressure pump including a female piston is a liquid-pressure pump of PTL 1, for example.

The female piston of the liquid-pressure pump of PTL 1 includes a concave spherical surface, and a convex spherical portion of a shoe is supported by the concave spherical surface so as to be slidable and rotatable. Therefore, as with the male piston, the piston can rotate relative to the shoe around a center point of the convex spherical portion, and pressure resistance performance of the piston and the shoe can be improved.

CITATION LIST

Patent Literature

PTL 1: Japanese Laid-Open Patent Application Publication No. 2014-152753

SUMMARY OF INVENTION

Technical Problem

According to the liquid-pressure pump of PTL 1, an increase in pressure of operating oil used therein is required, and the liquid-pressure pump is desired to receive and eject the operating oil of, for example, 28 Mpa or more. Due to such increase in pressure of the operating oil, a high load acts on the shoe from the piston, and large reaction force acts on the concave spherical surface of the piston from the convex spherical portion of the shoe. Therefore, if a contact surface between the concave spherical surface and the convex spherical portion is small, high surface pressure locally acts on the concave spherical surface, and this damages the concave spherical surface. On this account, the contact surface between the concave spherical surface and the convex spherical portion is made large by accurately forming the concave spherical surface and the convex spherical portion through cutting work, and this reduces the surface pressure.

However, according to conventional arts, a cutting step of cutting a piston (material) produced through a forming step such as extrusion, forging, or shaving needs to be performed in addition to the forming step, and this increases a workload. Further, according to the cutting work, portions to be cut are left at the material produced through the forming step, and the accuracy of the material is improved by cutting the portions to be cut. Therefore, the portions to be cut are waste of material. As above, since the workload increases, and the waste of material occurs, a manufacturing cost for the piston increases.

An object of the present invention is to provide a piston capable of bearing high pressure and reducing a manufacturing cost, and a liquid-pressure rotating device including the piston.

Solution to Problem

A piston of the present invention is a piston including: a concave spherical portion formed at one of end portions of the piston and supporting a spherical joint portion of a shoe of a liquid-pressure rotating device such that the spherical joint portion is slidable and rotatable; a cylindrical hollow portion formed at the other end portion of the piston; and an oil passage formed between the concave spherical portion and the hollow portion, the concave spherical portion and the hollow portion communicating with each other through the oil passage, wherein: the concave spherical portion includes a concave spherical surface formed by forging; the concave spherical surface includes a semi-spherical surface region; and an area of contact between the semi-spherical surface region and a master ball that is a basis of the spherical joint portion is 40% or more of an entire area of the semi-spherical surface region.

According to the present invention, a load acting on the concave spherical portion of the piston from the spherical joint portion of the shoe can be received by a wide region of the concave spherical surface, and surface pressure (load per unit area) acting on the concave spherical surface can be reduced. With this, even when a high load acts on the piston for the purpose of ejecting high-pressure operating oil, the concave spherical portion is not damaged, and the spherical joint portion can smoothly move in the concave spherical portion. Therefore, the concave spherical surface formed only by forging can bear high pressure, and a manufacturing cost for the piston can be reduced.

The above invention may be configured such that: the concave spherical surface includes a first ring-shaped region in a range where an angle to a central axis of the piston is not less than 35° and not more than 50°; and the first ring-shaped region is formed such that an area of contact between the first ring-shaped region and the master ball is 50% or more of an entire area of the first ring-shaped region.

According to the above configuration, the spherical joint portion can be supported from the hollow portion side of the piston. With this, even when a further high load acts on the piston, the spherical joint portion can smoothly slide, and the piston can deal with further high pressure.

The above invention may be configured such that: the concave spherical surface includes a second ring-shaped region formed between a ring-shaped first boundary and a ring-shaped second boundary; the first boundary is a border line between the oil passage and the concave spherical surface; the second boundary is a border line defined at a position where an angle between a central axis of the piston and a straight line connecting a center of the concave spherical surface and a surface of the concave spherical surface is 35°; and an area of contact between the concave spherical surface and the mater ball is 60% or more of an entire area of the second ring-shaped region.

According to the above configuration, partial contact of the spherical joint portion with the concave spherical surface can be suppressed. With this, sliding resistance of the spherical joint portion can be further reduced, and the piston can deal with further high pressure.

In the above invention, the oil passage may be continuous with the concave spherical portion so as to spread toward the concave spherical portion.

According to the above configuration, it is possible to prevent a case where the spherical joint portion sliding in the concave spherical portion contacts the connection portion between the concave spherical portion and the oil passage, and this generates locally high surface pressure. Therefore, without damaging the concave spherical portion, the spherical joint portion 15*a* can smoothly move, and the piston can deal with further high pressure.

The above invention may be configured such that: the hollow portion is formed in a cylindrical shape by an inner peripheral surface and a bottom surface; and the inner peripheral surface is formed such that a corner portion continuous with the bottom surface has an oval shape extending in an axial direction of the piston.

According to the above configuration, pressure concentration can be made lower than a case where round chamfering is just performed. Therefore, even if the corner portion has a curved surface of a smaller oval shape, the strength of the piston can be adequately satisfied. On this account, a forming load at the time of forging can be reduced. Thus, the hollow portion formed only by forging can bear high pressure, and the manufacturing cost for the piston can be reduced.

The above invention may be configured such that: the oil passage is formed by forging; and an aspect ratio of a hole diameter of the oil passage to a length of the oil passage is not less than 0.7 and not more than 1.2.

According to the above configuration, both the strength of the piston and the easiness of forging can be secured. With this, the oil passage formed only by forging can bear high pressure, and the manufacturing cost for the piston can be reduced.

A liquid-pressure rotating device of the present invention includes: a plurality of pistons each being any one of the above pistons; a swash plate; a plurality of shoes supported by the swash plate so as to be slidable, the shoes including respective convex spherical portions attached to respective concave spherical portions of the pistons; and a cylinder block into which the plurality of pistons are inserted so as to reciprocate.

According to the above configuration, the liquid-pressure rotating device having the above functions can be produced.

Advantageous Effects of Invention

The present invention can bear high pressure and reduce a manufacturing cost.

The above object, other objects, features, and advantages of the present invention will be made clear by the following detailed explanation of preferred embodiments with reference to the attached drawings.

DESCRIPTION OF EMBODIMENTS

Hereinafter, a hydraulic pump 1 and a piston 2 according to an embodiment of the present invention will be explained in reference to the drawings. It should be noted that directions stated in the following explanations are used for convenience of explanation, and directions and the like of components of the present invention are not limited. Further, the hydraulic pump 1 and the piston 2 explained below are just one embodiment of the present invention. Therefore, the present invention is not limited to the embodiment, and additions, deletions, and modifications may be made within the scope of the present invention.

Hydraulic Pump

Figure 1:
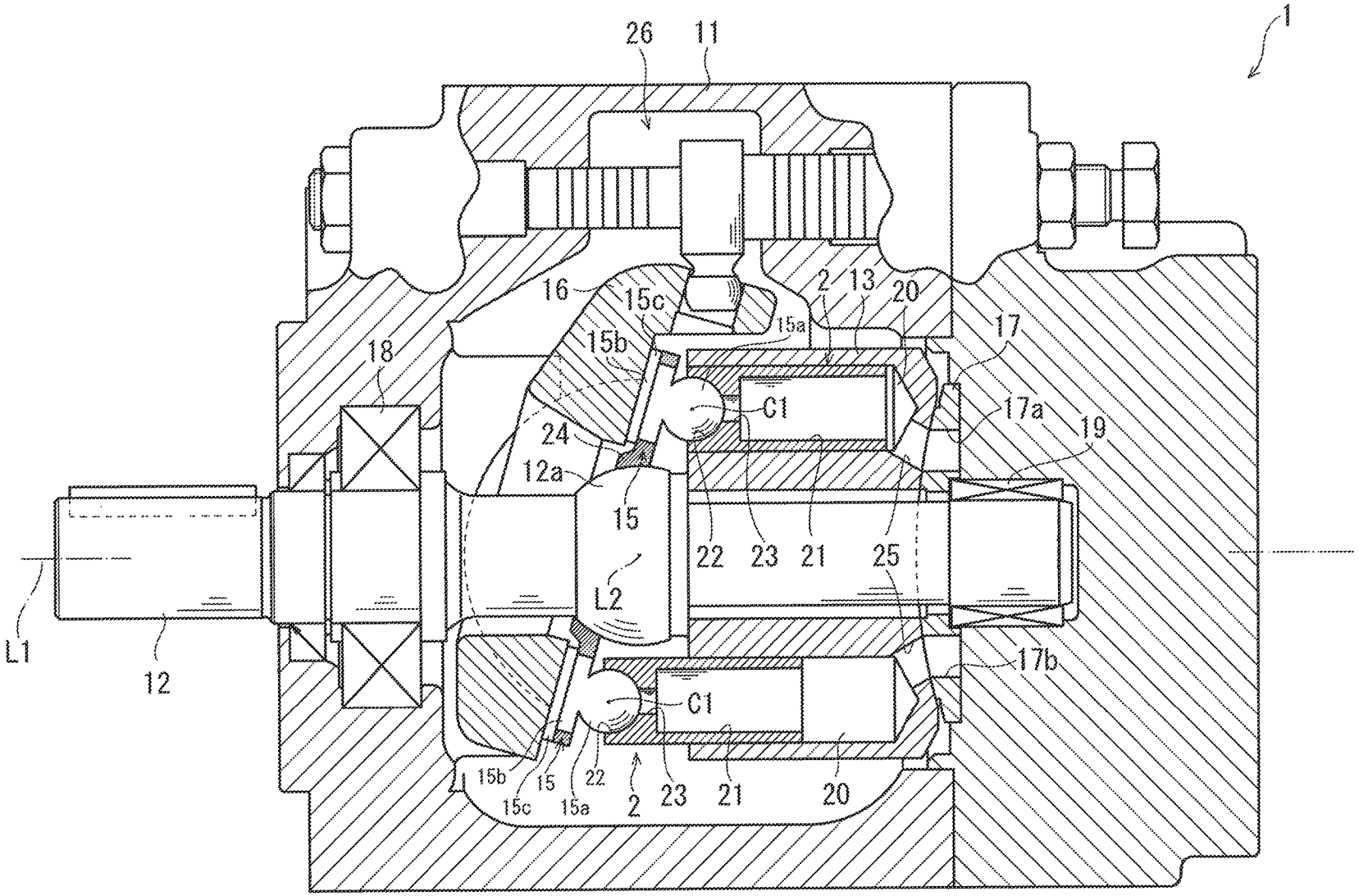
FIG. 1 is a sectional view showing a hydraulic pump according to an embodiment of the present invention.

The hydraulic pump 1 pressurizes sucked low-pressure operating oil and ejects high-pressure operating oil. For example, the hydraulic pump 1 supplies the operating oil to a hydraulic device such as a hydraulic piston mechanism or a hydraulic motor to drive the hydraulic device. The hydraulic pump 1 shown in FIG. 1 is a so-called variable displacement swash plate pump and includes a casing 11, a rotating shaft 12, a cylinder block 13, a plurality of pistons 2, a plurality of shoes 15, a swash plate 16, and a valve plate 17. The casing 11 is configured to accommodate the components 2 and 12 to 17, and one of end portions of the rotating shaft 12 projects from the casing 11. Bearings 18 and 19 are provided at a portion, close to the one end portion, of the rotating shaft 12 and the other end portion of the rotating shaft 12, respectively. The rotating shaft 12 is supported by the casing 11 through the bearings 18 and 19 so as to be rotatable. The cylinder block 13 is inserted through a portion, close to the other end portion, of the rotating shaft 12.

The cylinder block 13 is formed in a substantially cylindrical shape. The cylinder block 13 is coaxially coupled (for example, splined) to the rotating shaft 12 so as not to be rotatable relative to the rotating shaft 12. Therefore, the cylinder block 13 rotates around an axis L1 integrally with the rotating shaft 12. The cylinder block 13 includes a plurality of cylinder chambers 20. The plurality of cylinder chambers 20 are arranged at regular intervals in a circumferential direction around the axis L1. Each of the cylinder chambers 20 is a hole that is open at one end side of the cylinder block 13 and extends in parallel with the axis L1. The pistons 2 are inserted into the respective cylinder chambers 20 through the openings.

Each of the pistons 2 is a so-called female piston and is formed in a substantially cylindrical shape. A hollow portion 21 and a concave spherical portion 22 are formed at both respective end portions of the piston 2. The hollow portion 21 is a cylindrical portion that is open at a tip end of the piston 2 and extends toward a base end of the piston 2 from the tip end. The concave spherical portion 22 is a portion that is open at the base end of the piston 2 and is formed in a partially spherical shape. The hollow portion 21 and the concave spherical portion 22 are formed on an axis L2 of the piston 2 and are arranged away from each other in an axial direction (i.e., arranged at the tip end side and the base end side, respectively). An oil passage 23 is formed between the hollow portion 21 and the concave spherical portion 22, and the hollow portion 21 and the concave spherical portion 22 communicate with each other through the oil passage 23. The shoes 15 each having a convex spherical portion are attached to the respective pistons 2 configured as above.

Each of the shoes 15 includes a spherical joint portion (convex spherical portion) 15*a* and a base body portion 15*b*. A steel ball that is the spherical joint portion 15*a* is formed in a substantially spherical shape and is formed based on, for example, ball grades G3 to G100 showing "Form and Surface Roughness Tolerances" of JIS B 1501 defining steel balls for rolling bearings. The spherical joint portion 15*a* having such shape is fitted in the concave spherical portion 22 of the piston 2 to be subjected to caulking. The spherical joint portion 15*a* rotates around a center point C1 of the concave spherical portion 22. The spherical joint portion 15*a* is formed integrally with the base body portion 15*b*. The base body portion 15*b* is formed in a substantially circular plate shape, and the spherical joint portion 15*a* is integrally formed on one of thickness-direction surfaces of the base body portion 15*b*. The other thickness-direction surface of the base body portion 15*b* is formed to be flat and is pressed against the swash plate 16.

The swash plate 16 is a substantially annular plate and is arranged in the casing 11 with the rotating shaft 12 inserted into an inner hole of the swash plate 16. One of thickness-direction surfaces of the swash plate 16 is formed to be flat and forms a supporting surface 16*a*. The supporting surface 16*a* faces one of end surfaces of the cylinder block 13 so as to be inclined relative to the one end surface, and the base body portions 15*b* of the plurality of shoes 15 are arranged on the supporting surface 16*a* at intervals in the circumferential direction. A retainer plate 24 is provided at the rotating shaft 12 so as to press the plurality of shoes 15 against the supporting surface 16*a*.

The retainer plate 24 is formed in a substantially annular shape, and the rotating shaft 12 is inserted through an inner hole of the retainer plate 24. Further, the retainer plate 24 includes a plurality of holes arranged at intervals in the circumferential direction. The plurality of holes of the retainer plate 24 are formed so as to correspond to the plurality of shoes 15 arranged on the supporting surface 16*a*, and the base body portions 15*b* of the shoes 15 are fitted in the respective holes of the retainer plate 24. The base body portion 15*b* includes a flange 15*c* that is an outer peripheral portion and is formed at a portion close to the swash plate 16 (i.e., at a portion close to the other surface) so as to have a larger diameter than the hole. The flange 15*c* is sandwiched by the retainer plate 24 and the swash plate 16. The rotating shaft 12 includes a spherical bushing 12*a* at a position where the retainer plate 24 is provided. The retainer plate 24 fits the spherical bushing 12*a* and is held by an outer peripheral surface of the spherical bushing 12*a*. The spherical bushing 12*a* is coupled (for example, splined) to the rotating shaft 12 so as not to be rotatable relative to the rotating shaft 12 and is biased toward the swash plate 16 by a cylinder spring (not shown). With this, the plurality of shoes 15 are pressed against the supporting surface 16*a* by the retainer plate 24.

The plurality of shoes 15 rotate around the axis L1 on the supporting surface 16*a*. To be specific, when the rotating shaft 12 rotates, and the cylinder block 13 and the retainer plate 24 rotate around the axis L1 accordingly, the plurality of shoes 15 rotate around the axis L1. The supporting surface 16*a* is inclined relative to one end surface of the cylinder block 13, so that when the plurality of shoes 15 rotate around the axis L1, each of the shoes 15 approaches to and separates from the end surface of the cylinder block 13. With this, the pistons 2 attached to the shoes 15 reciprocate in the cylinder chambers 20 while rotating around the axis L1.

A plurality of cylinder ports 25 are formed at the other end side of the cylinder block 13. The cylinder ports 25 are formed so as to correspond to the cylinder chambers 20 one to one. The plurality of cylinder ports 25 include respective openings at the other end of the cylinder block 13, and the openings are arranged at intervals in the circumferential direction around the axis L1. The valve plate 17 is provided at the other end of the cylinder block 13.

The valve plate 17 is formed in a substantially circular plate shape. The rotating shaft 12 is inserted through the valve plate 17 so as to be rotatable relative to the valve plate 17. The valve plate 17 is fixed to the casing 11 with one of thickness-direction surfaces thereof contacting the other end of the cylinder block 13. The valve plate 17 includes an inlet port 17*a* and an outlet port 17*b*. Each of the inlet port 17*a* and the outlet port 17*b* is a hole that penetrates the valve plate 17 in a thickness direction and extends in a circumferential direction. The inlet port 17*a* and the outlet port 17*b* are arranged so as to be spaced apart from each other in the circumferential direction. The inlet port 17*a* and the outlet port 17*b* are arranged so as to correspond to the plurality of cylinder ports 25. When the cylinder block 13 rotates, the port to which each cylinder port 25 is connected is switched between the ports 17*a* and 17*b*. It should be noted that for convenience of explanation, FIG. 1 shows that the cylinder port 25 at a bottom dead center and the cylinder port 25 at a top dead center are coupled to the ports 17*a* and 17*b*, respectively. However, actually, the port to which the cylinder port 25 is connected switches from the inlet port 17*a* to the outlet port 17*b* in the vicinity of the bottom dead center (position at a lower side in FIG. 1) and switches from the outlet port 17*b* to the inlet port 17*a* in the vicinity of the top dead center (position at an upper side in FIG. 1).

In the hydraulic pump 1 configured as above, when the rotating shaft 12 rotates, the plurality of pistons 2 reciprocate in the respective cylinder chambers 20. With this, the operating oil is sucked through the inlet port 17*a* to the cylinder chamber 20, and the operating oil in the cylinder chamber 20 is ejected through the outlet port 17*b*. A flow rate of the operating oil ejected through the port 17*b* changes depending on an angle of the swash plate 16. To change the angles of the swash plate 16 and the retainer plate 24, the hydraulic pump 1 includes a servo mechanism 26. The servo mechanism 26 is configured to be able to tilt the swash plate 16 around the axis L2. A stroke amount of the piston 2 changes by the tilting of the swash plate 16. With this, the amount of operating oil ejected through the outlet port 17*b* (i.e., a pump capacity) can be changed.

Forged Piston

Figure 2:
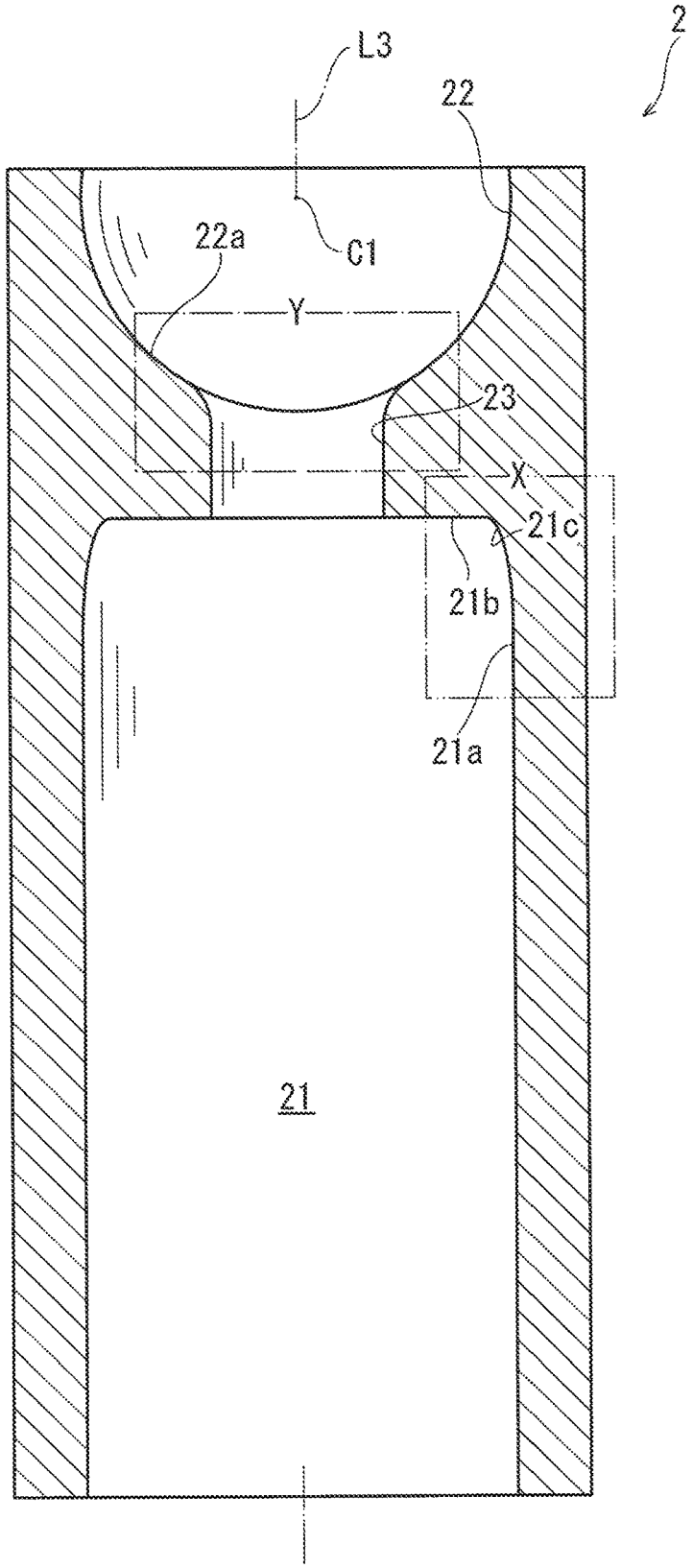
FIG. 2 is a sectional view showing a piston included in the hydraulic pump of FIG. 1.

In the hydraulic pump 1 having such functions, a female piston is used as the piston 2 as shown in FIG. 2. The piston 2 is formed by forging using a low-strength material such as SCM415 or carbon steel containing 0.2% of carbon. More specifically, the entire piston 2 including the hollow portion 21, the concave spherical portion 22, and the oil passage 23 is formed by cold forging with a press machine or the like. After that, an outer peripheral surface of the piston 2 is subjected to normalizing, cutting work, polishing, and a hardening treatment (such as a gas nitrocarburizing treatment or a salt-bath nitrocarburizing treatment). The hollow portion 21, the concave spherical portion 22, and the oil passage 23 that are inner peripheral surfaces of the piston 2 are formed only by cold forging. To be specific, according to the present invention, predetermined shapes of the hollow portion 21, the concave spherical portion 22, and the oil passage 23 which are internal shapes of the piston 2 are designed. With this, the internal shapes of the piston 2 can be formed only by forging at a practical level. Therefore, the present invention can realize the piston 2 capable of being produced at low cost while securing durability. Hereinafter, especially excellent shapes of the hollow portion 21, the concave spherical portion 22, and the oil passage 23 will be explained.

Shape of Hollow Portion

Figure 3:
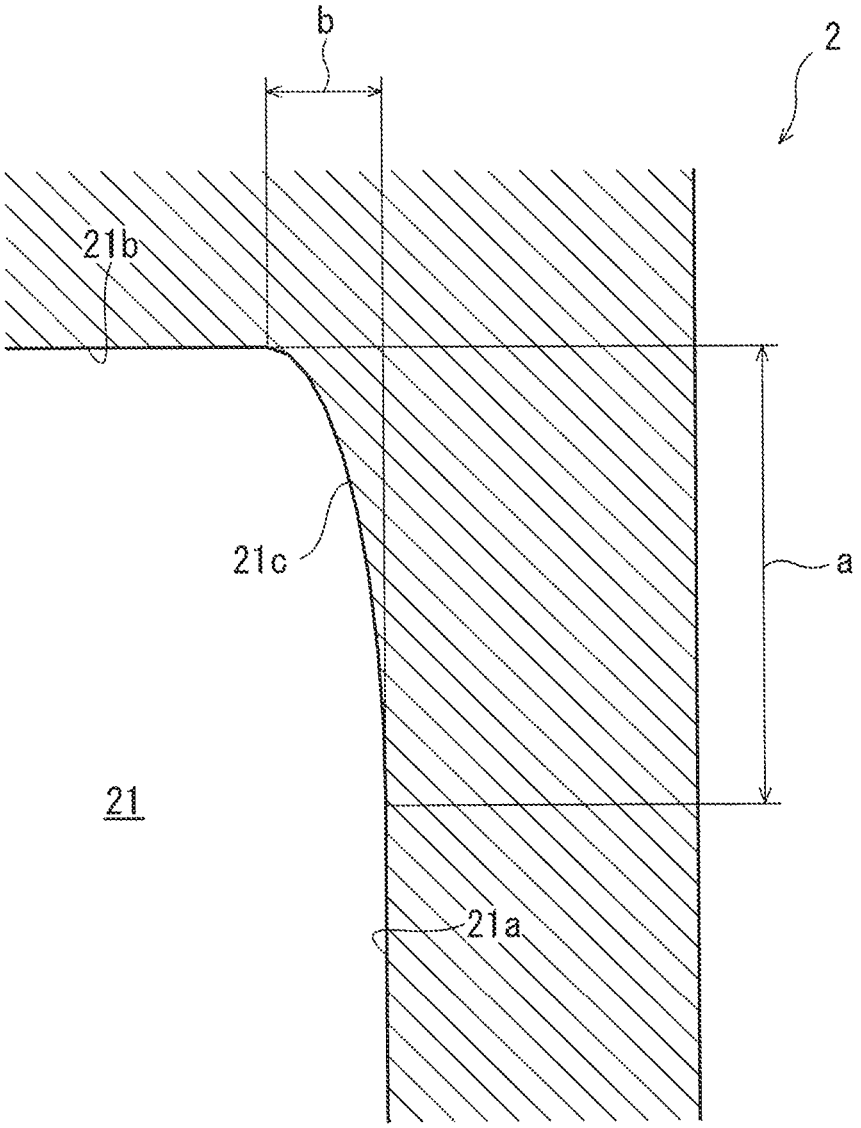
FIG. 3 is an enlarged sectional view showing the vicinity of a concave spherical surface of the piston of FIG. 2.
Figure 4:
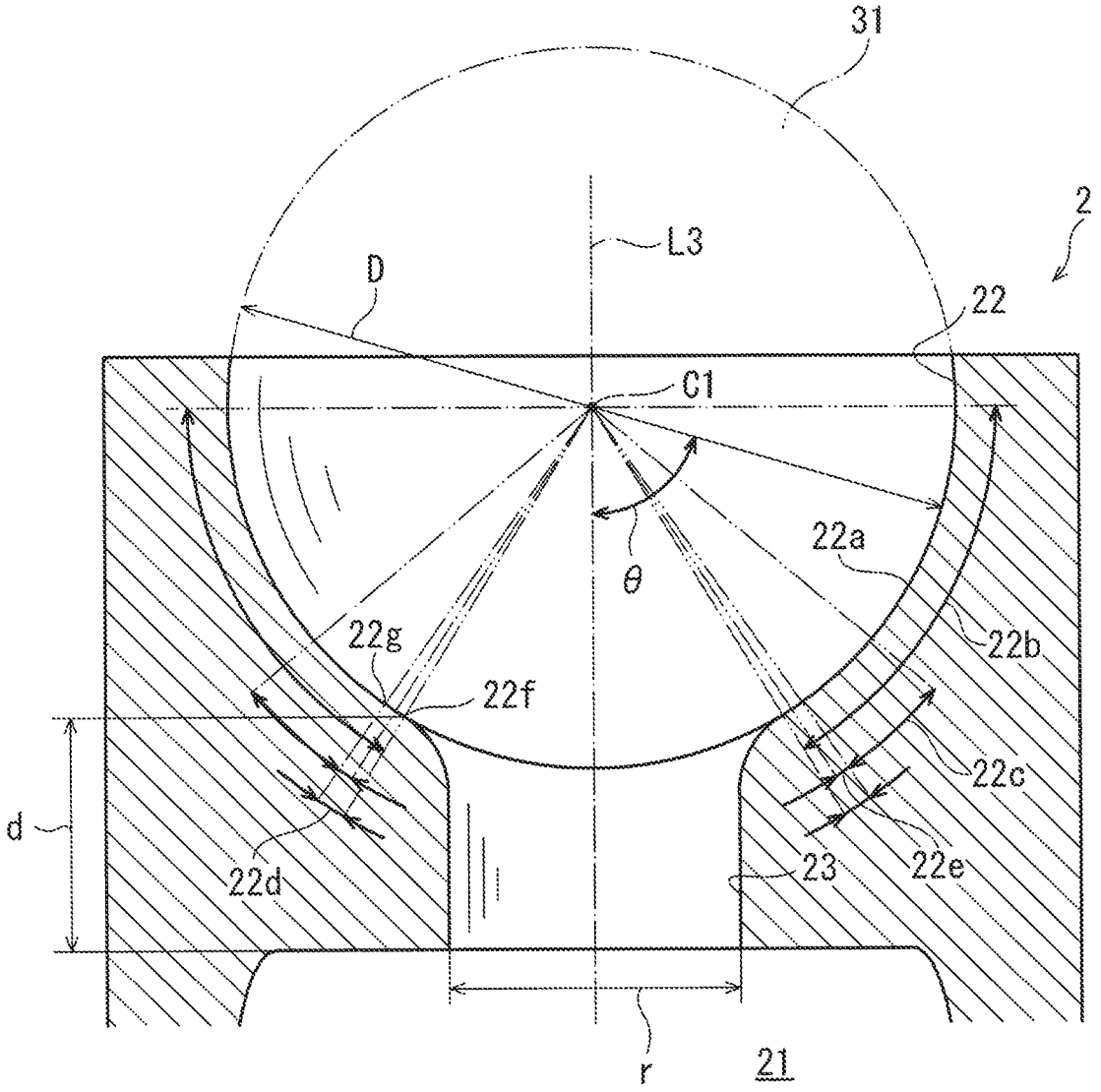
FIG. 4 is an enlarged sectional view showing a region X of the piston of FIG. 2.
Figure 5:
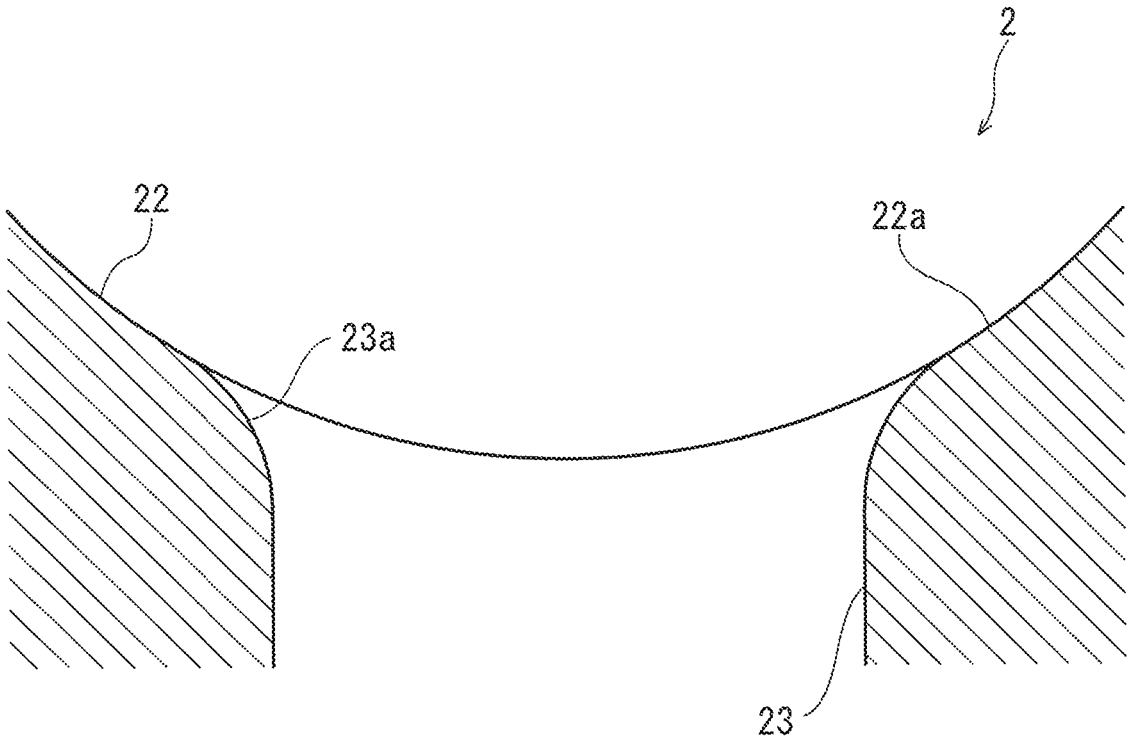
FIG. 5 is an enlarged sectional view showing a region Y of the piston of FIG. 2.

The hollow portion 21 is formed in a cylindrical shape as described above and includes an inner peripheral surface 21*a* and a bottom surface 21*b*. The inner peripheral surface 21*a* is formed around an axis L3 of the piston 2, and the bottom surface 21*b* is formed so as to be perpendicular to the axis L3. The inner peripheral surface 21*a* is continuous with the bottom surface 21*b* at the base end side thereof and includes a corner portion 21*c* continuous with the bottom surface 21*b*. As shown in FIG. 3, in a section including the axis L3, the corner portion 21*c* is formed so as to curve and taper toward the bottom surface 21*b*. In the present embodiment, the corner portion 21*c* is formed in a substantially quarter oval shape (long circular-arc shape) that is vertically long in a direction in which the axis L3 extends. The corner portion 21*c* is formed such that a ratio of a short axis b to a long axis a, i.e., an ellipticity b/a falls within a range of not less than 0.3 and not more than 0.7. Since the corner portion 21*c* is formed in a substantially quarter oval shape as above, pressure concentration can be made lower than a case where round chamfering of the corner portion 21*c* is performed. Therefore, even if the corner portion 21*c* has a curved surface of a smaller oval shape, the strength of the piston can obtain a practical level. On this account, the hollow portion 21 formed only by forging can secure durability, and a manufacturing cost for the piston 2 and the hydraulic pump 1 can be reduced by forming the hollow portion 21 only by forging. Further, since a forming load at the time of forging can be reduced, forging formability improves.

Shape of Concave Spherical Portion

Before the spherical joint portion 15*a* of the shoe 15 is attached to the concave spherical portion 22, the vicinity of the opening of the concave spherical portion 22 (i.e., an upper portion of the concave spherical portion 22) has a cylindrical shape, and a bottom side of the concave spherical portion 22 (i.e., a lower portion of the concave spherical portion 22) has a semi-spherical shape. When the spherical joint portion 15*a* is fitted in the concave spherical portion 22, and the outer peripheral surface of the concave spherical portion 22 is pushed inward and caulked, the concave spherical portion 22 is formed to have a partially spherical shape. With this, the spherical joint portion 15*a* of the shoe 15 is wrapped by the concave spherical portion 22, is rotatable relative to the piston 2, and does not separate from the piston 2. At a bottom side of the concave spherical portion 22, a concave spherical surface 22*a* that is an inner surface of the concave spherical portion 22 is formed only by forging so as to correspond to an outer surface (i.e., a spherical surface) of the spherical joint portion 15*a*. Hereinafter, the shape of the concave spherical surface 22*a* will be explained in detail.

A center (i.e., the center point C1) of the concave spherical surface 22*a* is located on the axis L3 of the piston 2. A region where an angle θ to the central axis (axis L3) of the piston 2 is not more than 90° is a semi-spherical surface region 22*b* of the concave spherical surface 22*a*. In other words, a region where an angle θ between the axis L3 and a straight line connecting the center (center point C1) of the concave spherical surface 22*a* and a surface of the concave spherical surface 22*a* is not more than 90° is the semi-spherical surface region 22*b* of the concave spherical surface 22*a*. Herein, the semi-spherical surface region 22*b* of the concave spherical surface 22*a* is a region where the angle θ to the central axis (axis L3) of the piston 2 when the oil passage 23 is formed at the piston 2 is not more than 90°.

Contact between the concave spherical surface 22*a* and the spherical joint portion 15*a* is confirmed by using, for example, a master ball 31 formed based on ball grades G3 to G100 showing "Form and Surface Roughness Tolerances" of JIS B 1501 defining steel balls for rolling bearings. The master ball 31 is a basis of the steel ball of the spherical joint portion 15*a*, and the steel ball of the spherical joint portion 15*a* is formed based on the same standard and conditions as the master ball 31. Therefore, a determination of contact between the master ball 31 and the semi-spherical surface region 22*b* of the concave spherical surface 22*a* and a determination of contact between the spherical joint portion 15*a* and the semi-spherical surface region 22*b* of the concave spherical surface 22*a* can be regarded as the same as each other. The master ball 31 is formed to have a set diameter D with tolerance of, for example, a predetermined size or less (such as ±5 μm or less). Further, paint (for example, bearing red) is applied to an outer peripheral surface of the master ball 31 with a predetermined thickness (for example, 10 μm or less), and the master ball 31 is pressed against the concave spherical surface 22*a* with predetermined pressing force (for example, 1 to 5 kgf). In this case, a portion where the paint is transferred is determined as a portion where the concave spherical surface 22*a* and the spherical joint portion 15*a* contact each other. When an area (transfer area) of a region where the paint is transferred is 40% or more of the entire area of the semi-spherical surface region 22*b*, a contact area is regarded as 40% or more. In the present embodiment, the piston 2 is formed such that the contact area that is an area of contact between the semi-spherical surface region 22*b* of the concave spherical surface 22*a* and the master ball 31 is 40% or more of the entire area of the semi-spherical surface region 22*b*.

As above, the contact area is set to 40% or more. Therefore, when the piston 2 pushes the operating oil or when the piston 2 is pushed by the operating oil, a load from the spherical joint portion 15*a* can be received by a wide region of the concave spherical surface 22*a*, and surface pressure (load per unit area) acting on the concave spherical surface 22*a* can be reduced. With this, even when a high load acts on the piston 2 for the purpose of ejecting high-pressure (for example, 28 MPa) operating oil, the concave spherical portion 22 is not damaged, and the spherical joint portion 15*a* can smoothly move in the concave spherical portion 22. Therefore, the concave spherical surface 22*a* formed only by forging can bear high pressure, and the manufacturing cost for the piston 2 and the hydraulic pump 1 can be reduced by forming the concave spherical surface 22*a* only by forging.

On the concave spherical surface 22*a*, a region where the angle θ to the central axis (axis L3) of the piston 2 is not less than 35° and not more than 50° is a first ring-shaped region 22*c*. In other words, a region where the angle θ between the axis L3 and the straight line connecting the center of the concave spherical surface 22*a* and the surface of the concave spherical surface 22*a* is not less than 35° and not more than 50° is the first ring-shaped region 22*c*. The piston 2 is formed such that the contact area (i.e., contact in the circumferential direction) is 50% or more of the entire area of the first ring-shaped region 22*c*. To be specific, the piston 2 is formed such that the transfer area when the paint is transferred by pressing the master ball 31 against the concave spherical surface 22*a* under the above-described conditions is 50% or more of the entire area of the first ring-shaped region 22*c*. As above, when the contact area at the first ring-shaped region 22*c* is set to 50% or more, an axial load applied from the spherical joint portion 15*a* by the reciprocating movement can be received by a wide surface of a bottom portion (ring-shaped surface in the vicinity of the axis L3) of the concave spherical surface 22*a*, and the surface pressure acting on the concave spherical surface 22*a* can be reduced. With this, the spherical joint portion 15*a* can be supported in the axial direction in a state where the surface pressure acting on the concave spherical surface 22*a* of the piston 2 is low. Therefore, even when a further high load acts on the piston 2, the spherical joint portion 15*a* can smoothly slide, and the piston 2 and the hydraulic pump 1 can deal with further high ejection pressure.

On the concave spherical surface 22*a*, a region formed between a ring-shaped first boundary 22*f* and a ring-shaped second boundary 22*g* is a second ring-shaped region 22*d*. The ring-shaped first boundary 22*f* is a portion where the oil passage 23 and the concave spherical surface 22*a* are connected to each other. That is, the ring-shaped first boundary 22*f* is a border line between the oil passage 23 and the concave spherical surface 22*a*. Further, the ring-shaped second boundary 22*g* is a portion where the concave spherical surface 22*a* intersects with a straight line that connects the center of the concave spherical surface 22*a* and the surface of the concave spherical surface 22*a*, has the angle θ of 35° to the central axis (axis L3) of the piston, and is rotated around the axis L3. That is, the ring-shaped second boundary 22*g* is a border line defined at a position where the angle θ is 35° on the concave spherical surface 22*a*. The piston 2 is formed such that the area of contact between the master ball 31 and the second ring-shaped region 22*d* of the concave spherical surface 22*a* is 60% or more of the entire area of the second ring-shaped region 22*d*. To be specific, the piston 2 is formed such that the transfer area when the paint is transferred by pressing the master ball 31 against the concave spherical surface 22*a* under the above-described conditions is 60% or more of the entire area of the second ring-shaped region 22*d*. As above, when the contact in the circumferential direction of the second ring-shaped region 22*d* is set to 60% or more, partial contact of the spherical joint portion 15*a* with the concave spherical surface 22*a* can be suppressed. With this, the surface pressure acting on the concave spherical surface 22*a* can be uniformized, and the piston 2 and the hydraulic pump 1 can deal with further high ejection pressure.

On the concave spherical surface 22*a*, a region where the angle θ to the central axis (axis L3) of the piston 2 is not less than 33° and not more than 35° is a third ring-shaped region 22*e*. In other words, a region where the angle θ between the axis L3 and the straight line connecting the center of the concave spherical surface 22*a* and the surface of the concave spherical surface 22*a* is not less than 33° and not more than 35° is the third ring-shaped region 22*e*. The piston 2 is formed such that the contact area (i.e., contact in the circumferential direction) is 60% or more of the entire area of the third ring-shaped region 22*e*. To be specific, the piston 2 is formed such that the transfer area when the paint is transferred by pressing the master ball 31 against the concave spherical surface 22*a* under the above-described conditions is 60% or more of the entire area of the third ring-shaped region 22*e*. As above, when the contact in the circumferential direction of the third ring-shaped region 22*e* is set to 60% or more, partial contact of the spherical joint portion 15*a* with the concave spherical surface 22*a* can be suppressed. With this, the surface pressure acting on the concave spherical surface 22*a* can be uniformized, and the piston 2 and the hydraulic pump 1 can deal with further high ejection pressure.

Shape of Oil Passage

The oil passage 23 is a through hole through which the hollow portion 21 and the concave spherical portion 22 communicate with each other and which has a substantially circular section. An aspect ratio that is a ratio of a hole diameter r to a depth d falls within a range of not less than 0.7 and not more than 1.2. By forming the oil passage 23 as above, both the strength of the piston 2 and the easiness of forging can be secured. With this, the oil passage 23 formed only by forging can bear high pressure, and the manufacturing cost for the piston can be reduced by forming the oil passage 23 by forging.

A connection portion 23*a* where the oil passage 23 and the concave spherical portion 22 are connected to each other is subjected to round chamfering. The connection portion 23*a* has a fillet shape. To be specific, the connection portion 23*a* is formed so as to spread toward the concave spherical portion 22. This can prevent a case where the spherical joint portion 15*a* that slides and rotates in the concave spherical portion 22 contacts the connection portion 23*a*, this inhibits the rotation of the spherical joint portion 15*a*. With this, sliding resistance of the spherical joint portion 15*a* can be reduced, and the piston 2 and the hydraulic pump 1 can deal with further high pressure.

Other Embodiments

The above embodiment has explained an example where the liquid-pressure rotating device is the hydraulic pump 1. However, the liquid-pressure rotating device may be a hydraulic motor. An operating liquid sucked and ejected is not limited to the operating oil and may be a liquid such as water. Further, the above embodiment has explained an example where the hydraulic pump 1 is the variable displacement swash plate pump. However, the hydraulic pump 1 may be a fixed displacement swash plate pump. A device to which the piston 2 is applied is not limited to the liquid-pressure rotating device such as the hydraulic pump 1 and may be applied to an actuator or the like. The piston 2 does not necessarily have to include all the characteristic shapes of the hollow portion 21, the concave spherical portion 22, and the oil passage 23. Excellent operational advantages can be obtained by each characteristic shape, and further excellent operational advantages can be obtained by the above-described combination of the characteristic shapes.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1 hydraulic pump
2 piston
13 cylinder block
15 shoe
15*a* spherical joint portion
16 swash plate
21 hollow portion
21*a* inner peripheral surface
21*b* bottom surface
22 concave spherical portion
22*a* concave spherical surface
22*c* first ring-shaped region
22*d* second ring-shaped region
22*e* third ring-shaped region
22*f* first boundary
22*g* second boundary
23 oil passage
23*a* connection portion

The invention claimed is:

1. A piston comprising:

a concave spherical portion formed at one of end portions of the piston and supporting a spherical joint portion of a shoe of a liquid-pressure rotating device such that the spherical joint portion is slidable and rotatable;

a cylindrical hollow portion formed at an other of the end portions of the piston; and an oil passage formed between the concave spherical portion and the hollow portion, the concave spherical portion and the hollow portion communicating with each other through the oil passage, wherein:

the concave spherical portion includes a concave spherical surface formed by forging;

the concave spherical surface includes a semi-spherical surface region;

an area of contact between the semi-spherical surface region and a master ball that is a basis of the spherical joint portion is 40% or more of an entire area of the semi-spherical surface region; and a connection portion where the concave spherical portion and the oil passage are connected to each other is formed in a fillet shape so as to spread toward the concave spherical portion.

2. The piston according to claim 1, wherein:

the concave spherical surface includes a first ring-shaped region in a range where an angle to a central axis of the piston is not less than 35° and not more than 50°; and the first ring-shaped region is formed such that an area of contact between the first ring-shaped region and the master ball is 50% or more of an entire area of the first ring-shaped region.

3. The piston according to claim 1, wherein:

the concave spherical surface includes a second ring-shaped region formed between a ring-shaped first boundary and a ring-shaped second boundary;

the first boundary is a border line between the oil passage and the concave spherical surface;

the second boundary is a border line defined at a position where an angle between a central axis of the piston and a straight line connecting a center of the concave spherical surface and a surface of the concave spherical surface is 35°; and the second ring-shaped region is formed such that an area of contact between the second ring-shaped region and the master ball is 60% or more of an entire area of the second ring-shaped region.

4. The piston according to claim 1, wherein:

the oil passage is formed by forging; and a ratio of a hole diameter of the oil passage to a length of the oil passage is not less than 0.7 and not more than 1.2.

5. A liquid-pressure rotating device comprising:

a plurality of pistons each being the piston according to claim 1;

a swash plate;

a plurality of shoes supported by the swash plate so as to be slidable, the shoes including respective convex spherical portions attached to respective concave spherical portions of the pistons; and a cylinder block into which the plurality of pistons are inserted so as to reciprocate.

6. A piston comprising:

a concave spherical portion formed at one of end portions of the piston and supporting a spherical joint portion of a shoe of a liquid-pressure rotating device such that the spherical joint portion is slidable and rotatable;

a cylindrical hollow portion formed at an other of the end portions of the piston; and an oil passage formed between the concave spherical portion and the hollow portion, the concave spherical portion and the hollow portion communicating with each other through the oil passage, wherein:

the concave spherical portion includes a concave spherical surface formed by forging;

the hollow portion includes an inner peripheral surface and a bottom surface both formed by forging; and a connection portion where the concave spherical portion and the oil passage are connected to each other is formed in a fillet shape so as to spread toward the concave spherical portion.

7. The piston according to claim 6, wherein:

the oil passage is formed by forging; and a ratio of a hole diameter of the oil passage to a length of the oil passage is not less than 0.7 and not more than 1.2.

8. A liquid-pressure rotating device comprising:

a plurality of pistons each being the piston according to claim 6;

a swash plate;

a plurality of shoes supported by the swash plate so as to be slidable, the shoes including respective convex spherical portions attached to respective concave spherical portions of the pistons; and a cylinder block into which the plurality of pistons are inserted so as to reciprocate.

9. A piston comprising:

a concave spherical portion formed at one of end portions of the piston and supporting a spherical joint portion of a shoe of a liquid-pressure rotating device such that the spherical joint portion is slidable and rotatable;

a cylindrical hollow portion formed at an other of the end portions of the piston; and an oil passage formed between the concave spherical portion and the hollow portion, the concave spherical portion and the hollow portion communicating with each other through the oil passage, wherein:

the concave spherical portion includes a concave spherical surface formed by forging;

the hollow portion includes an inner peripheral surface and a bottom surface both formed by forging and is formed in a cylindrical shape by the inner peripheral surface and the bottom surface; and the inner peripheral surface is formed such that a corner portion continuous with the bottom surface has a long circular-arc shape that is vertically longer in an axial direction of the piston than that is horizontally in a direction perpendicular to the axial direction.

10. The piston according to claim 9, wherein:

the oil passage is formed by forging; and a ratio of a hole diameter of the oil passage to a length of the oil passage is not less than 0.7 and not more than 1.2.

11. A liquid-pressure rotating device comprising:

a plurality of pistons each being the piston according to claim 9;

a swash plate;

a plurality of shoes supported by the swash plate so as to be slidable, the shoes including respective convex spherical portions attached to respective concave spherical portions of the pistons; and a cylinder block into which the plurality of pistons are inserted so as to reciprocate.

* * * * *